US005211397A

United States Patent [19]

Davis et al.

[11] Patent Number: 5,211,397

[45] Date of Patent: May 18, 1993

[54] STRING VIBRATION DAMPENER FOR A TENNIS RACQUET

[75] Inventors: Stephen J. Davis, Yardley; Kenneth A. Stevens, Lansdale, both of Pa.

[73] Assignee: Prince Manufacturing, Inc., Princeton, N.J.

[21] Appl. No.: 827,864

[22] Filed: Jan. 30, 1992

Related U.S. Application Data

[63] Continuation of Ser. No. 535,840, Jun. 11, 1990, abandoned.

[51] Int. Cl.[5] ..... A63B 51/10

[52] U.S. Cl. ..... 273/73 D

[58] Field of Search ..... 273/73 R, 73 C, 73 D, 273/73 E, 73 G, 73 S

[56] References Cited

U.S. PATENT DOCUMENTS

| | | | |
|---|---|---|---|
| 2,732,209 | 1/1956 | Forbes | 273/73 R |
| 4,180,265 | 12/1979 | Staufer | 273/73 D |
| 4,575,083 | 3/1986 | Adam | 273/73 D |
| 4,589,662 | 5/1986 | Robaldo | 273/73 D |
| 4,609,194 | 9/1986 | Krent et al. | 273/73 D |
| 4,732,383 | 3/1988 | Ferrari et al. | 273/73 D |
| 4,761,007 | 8/1988 | Boschian | 273/73 D |
| 4,909,509 | 3/1990 | Boschian | 273/73 R X |
| 4,911,445 | 3/1990 | Ferrari et al. | 273/73 D |
| 4,962,928 | 10/1990 | Camara et al. | 273/73 D |

FOREIGN PATENT DOCUMENTS

| | | | |
|---|---|---|---|
| 8802271 | 4/1983 | World Int. Prop. O. | 273/73 D |
| 8901809 | 3/1989 | World Int. Prop. O. | 273/73 D |

OTHER PUBLICATIONS

1988 Tennis String International (TSI) Catalog p. 11.

*Primary Examiner*—V. Millan
*Assistant Examiner*—William E. Stoll
*Attorney, Agent, or Firm*—White & Case

[57] ABSTRACT

A vibration absorber for tennis racquet strings includes a thin, flexible strip with a relatively massive donut shape member at either end. The device is weaved over and under the racquet main strings, so that the flexible strip contacts preferably between 4 and 6 of the center main strings, and the donut members engage, through a clamping groove, a pair of outlying strings. The device provides a good vibration dampening on the outer part of the string area, for dampening off center hits, whereas the center main strings remain lively and resilient.

11 Claims, 8 Drawing Sheets

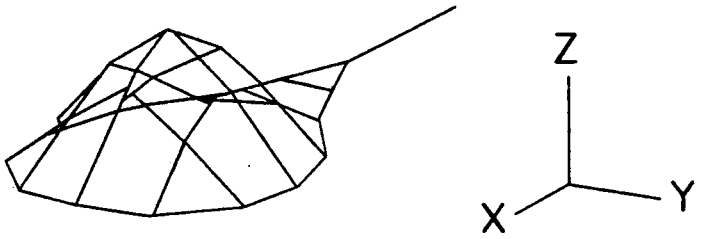
FIG. 8
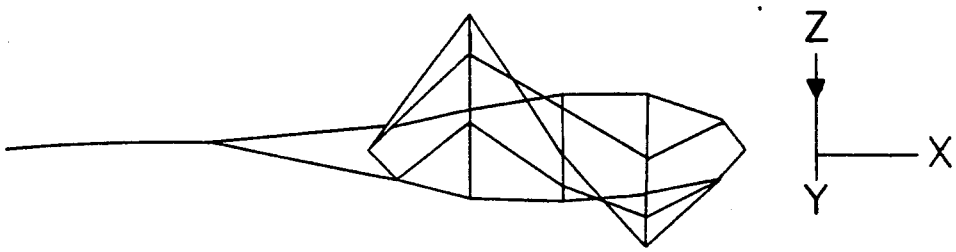
FIG. 9
FIG. 10
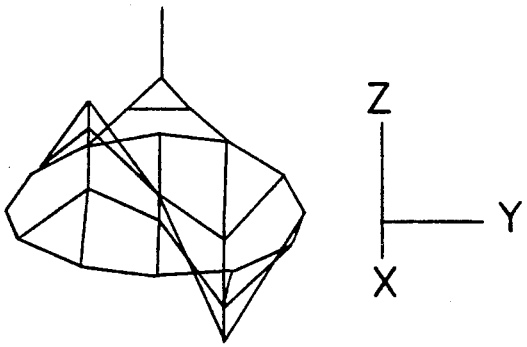

STRING VIBRATION DAMPENER FOR A TENNIS RACQUET

This application is a continuation of application Ser. No. 535,840, filed on Jun. 11, 1990 now abandoned.

The present invention is a device for dampening string vibration in tennis racquets.

After a tennis ball leaves the strings of a tennis racquet, the strings will continue to vibrate, at a relatively high frequency. Because these vibrations can be felt in the arm, there have previously been a number of proposals for dampening string vibrations. Basically, these proposals fall into one of two categories: (1) devices that are disposed between adjacent strings to dampen vibration; and (2) an elongated bar that weaves over and under the strings. These devices are normally positioned in an edge region of the strung surface, so as not to contact the ball.

Staufer U.S. Pat. No. 4,180,265 proposes a vibration absorber of the first type, and in particular an elastomeric viscoelastic coupling element which mechanically interlocks a pair of adjacent strings. Krent et al. U.S. Pat. No. 4,609,194 proposes another device of the first type, in the form of a highly compressible viscoelastic foam made of two different materials, which is compressed and inserted between adjacent strings. Another such proposal is disclosed in Boschian U.S. Pat. No. 4,761,007, in which a plate, inserted between the strings, includes a weight suspended in the middle for dampening vibration.

Examples of the second type are disclosed in Adam U.S. Pat. No. 4,575,083 and Ferrari et al. U.S. Pat. No. 4,732,383, where an elongated strip of vibration-absorbing material is woven over and under adjacent strings.

SUMMARY OF THE INVENTION

The present invention is a vibration dampening device which provides variable vibration dampening characteristics across the string plane. In particular, the vibration dampener according to the invention provides greater dampening according to the invention at the outer longitudinal strings, and less vibration dampening at the center longitudinal strings. Thus, in the case of balls hit on the outside portion of the racquet, which tend to produce undesirable responses, greater dampening is provided. In contrast, for balls hit in the center of the stringing area, the device causes less dampening so that the strings remain resilient and lively.

A vibration dampener according to the invention includes a relatively thin, flexible elastomeric strip having a pair of end sections of greater mass. Each end section includes a groove or other means for engaging a string. The dampener is applied by weaving it over and under adjacent racquet strings, and attaching each end section to one of the strings.

In an exemplary embodiment, the end sections are in the form of a pair of donut shape members, each with an outwardly facing clamping groove, in the shape of a keyhole slot, for engaging a string. The donut members and the connecting strip taper in width as well as thickness toward the center, such that the device is in the shape of a bow tie. In addition to the holes present in the donut members, which act to reduce wind resistance, holes may be provided in the strip for further reducing wind drag and to increase flexibility. By varying the spacing and size of the holes, it is also possible to vary the dampening ratios.

Preferably, each donut member is sized so as to fit between two adjacent longitudinal strings. One of the strings is received in the outward facing keyhole slot, and a second keyhole shape clamping groove is provided toward the inside, where the donut member and strip join, for receiving the other longitudinal string.

The strip preferably has a length such that it is woven over and under at least four, and most preferably six center longitudinal strings, with each donut member engaging the next pair of outlying strings on either side. In this manner, a relatively large dampening is applied to the four outlying strings which are engaged by the donuts, whereas less vibration dampening is applied to the center strings.

For a better understanding of the invention, reference is made to the following detailed description of a preferred embodiment, taken in conjunction with the drawings accompanying the application.

BRIEF DESCRIPTION OF THE DRAWINGS

FIGS. 8, 9 and 10 are computer plots of the string vibration pattern at three different frequencies.

DETAILED DESCRIPTION OF A PREFERRED EMBODIMENT

Figure 1:
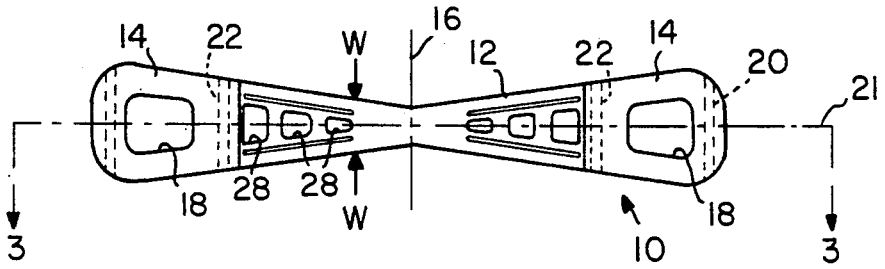
FIG. 1 is a front view of a vibration dampener according to the invention.

A vibration dampener 10 includes a relatively thin, flexible strip 12 and a donut-shaped member 14 of larger mass at each end thereof. Preferably, the dampener 10 is made as a thermoplastic elastomer, e.g. of about 50 shore A durometer, but other materials and durometers may be used.

In the exemplary embodiment, the width w—w (FIG. 1) as well as thickness t—t (FIG. 2) of the dampener 10 taper toward the center plane 16, so that the damper 10 has the overall shape of a bow tie, and the connecting strip 12 is thinnest and most flexible in the middle.

Figure 2:
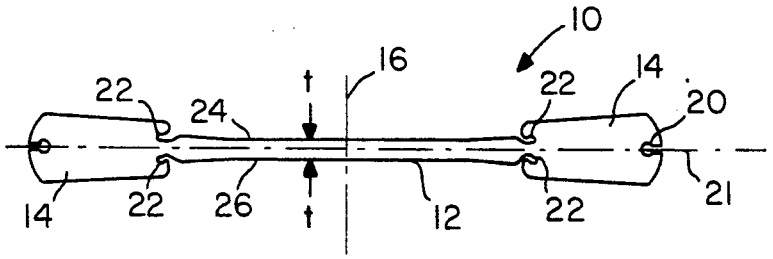
FIG. 2 is a side view of the dampener.
Figure 3:
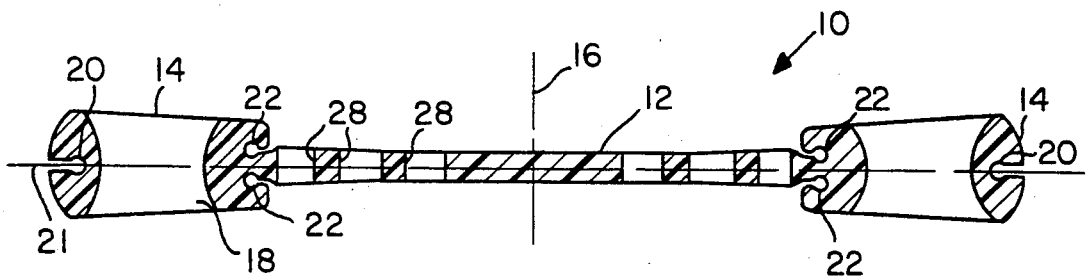
FIG. 3 is an enlarged, cross sectional view, taken through lines 3—3 of FIG. 1.

Each donut member 14 has a hole 18 that extends perpendicular to the strip 12, and also has an end clamping groove 20 that is perpendicular to the longitudinal axis 21 of the dampener 10. Each clamping groove 20 is sized to receive a standard tennis string in a keyhole fashion. Similarly, in addition to clamping grooves 20, a second pair of clamping grooves 22, which are parallel to clamping grooves 20, are provided between each donut member 14 and strip 12, on the top 24 and bottom 26 surfaces, respectively, of the dampener 10. As shown in FIGS. 2-3, due to the grooves 22 the strip 12 joins the donut 14 at a region of reduced thickness t—t, in effect forming a flexible joint. Finally, a series of holes 28 are formed though the strip 12, perpendicular to the plane of the strip 12, for reducing wind resistance as well as increasing flexibility. The size and spacing of holes 28 can be varied as desired to vary the dampening.

By way of example of approximate dimensions, the dampener may have an overall length of 95.5 mm. The strip 12 may have a length of 58 mm, a width that tapers from 14 mm at clamping grooves 22 to 6 mm at the center 16, and a thickness that decreases from 3.8 mm near the groove 22 to 3.0 mm at the center region. The donut member 14 may have a length of 22 mm (along axis 21), a thickness tapering (toward the middle of the dampener) from 10.7 mm to 8.8 mm, and a width tapering from 17 mm to about 14 mm where it joins the strip 12. As shown in FIG. 1, the width w—w of both the donut member 14 and strip 12 continue as a constant taper toward the center plane 16. Preferably, the strip 12 and donut members 14 are molded as one piece, but they can be molded separately.

Figure 4:
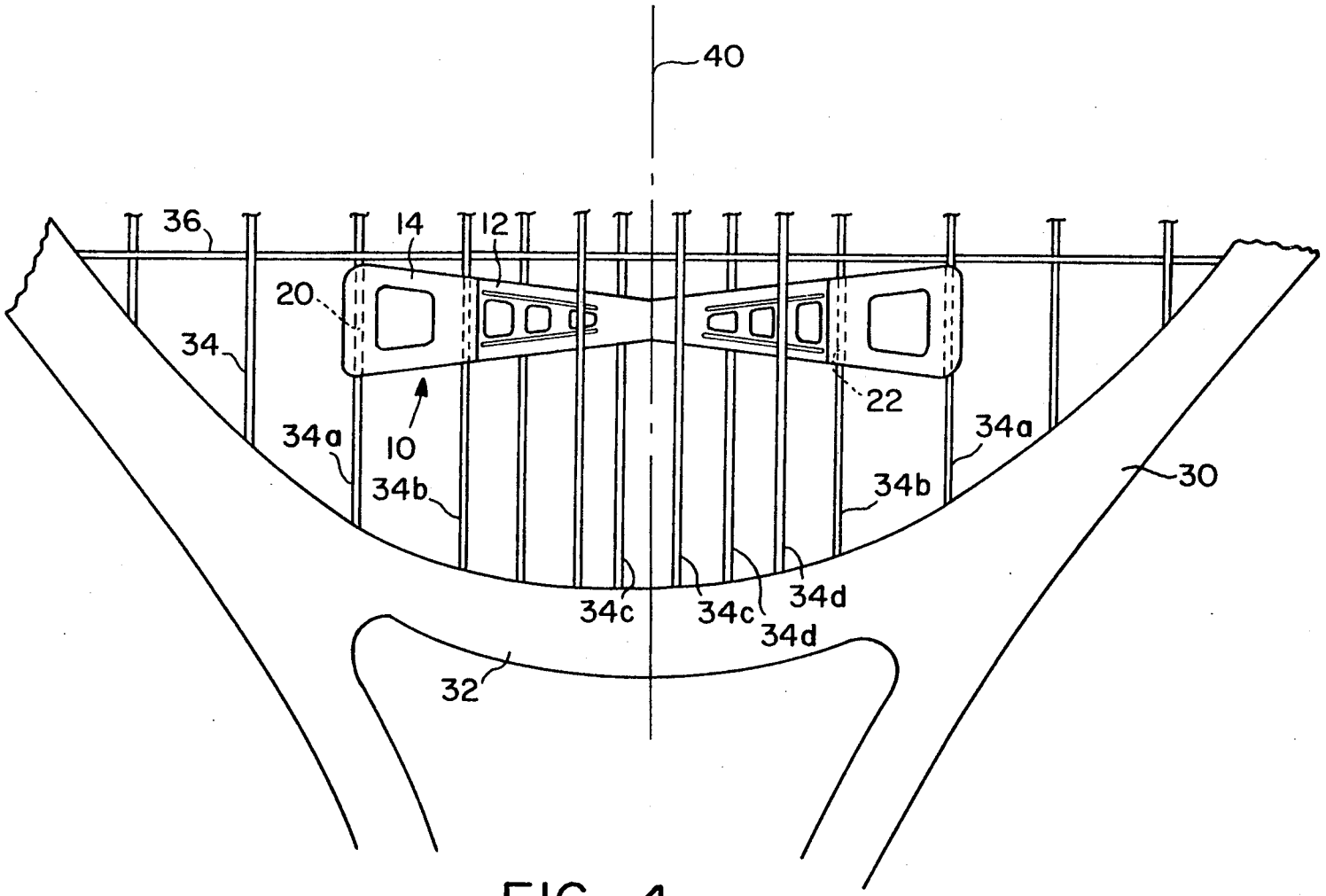
FIG. 4 is a front view of a portion of a tennis racquet, showing the vibration dampener is applied.

The preferred method of using the dampener 10 is illustrated in FIG. 4 which shows a portion of a tennis racquet frame 30, in the region of the throat bridge 32. FIG. 4 also illustrates a number of longitudinal or "main" strings 34, and the lowermost cross string 36. The strip 12 is woven alternatively over and under adjacent main strings 34, such that each donut member 14 is located between a pair of outlying main strings 34*a*, 34*b*. The clamping groove 20 of each member 14 is pushed into string 34*a*, and string 34*b* is received in the upper or lower clamping groove 22 as appropriate, the opposite sides of the end member 14 thereby being in frictional contact with the two, parallel strings 34*a*, 34*b*. Preferably, the dampener 10 is centered relative to the two centermost main strings 34*c* and racquet axis 40 and is positioned just below the lowermost cross string 36.

Since the strip 12, particularly near the center, is flexible and of relatively small mass, it effects dampening less than in the case of the donut members 14.

Thus, the center main strings 34*c-d*, and particularly the centermost strings 34*c*, remain lively and resilient. The donut members 14 dampen the string vibration of outer strings 34*a*, 34*b* much more effectively. Thus, in the case where the ball hits strings 34*a-b*, or strings further out on the racquet (i.e., since such strings are connected to string 34*a* to some extent by the cross strings), the periphery or outside of the string plane will be dampened much more effectively. This is beneficial since it is balls which are hit on the outside of the racquet that tend to produce undesirable responses, and therefore greater dampening in these areas is most desirable.

FIGS. 4A, 4B, 5A, 5B, 6A, 6B, 7A and 7B are plots of string vibration tests comparing the response of a tennis racquet with a dampener 10 according to the invention to a racquet without such dampener. Each of the tests was run with the racquet head fixed so as to isolate as best possible the vibration of the strings. In the case of racquets tested with a dampener 10, the dampener was mounted on the main strings in the manner of FIG. 4.

Figure 4A:
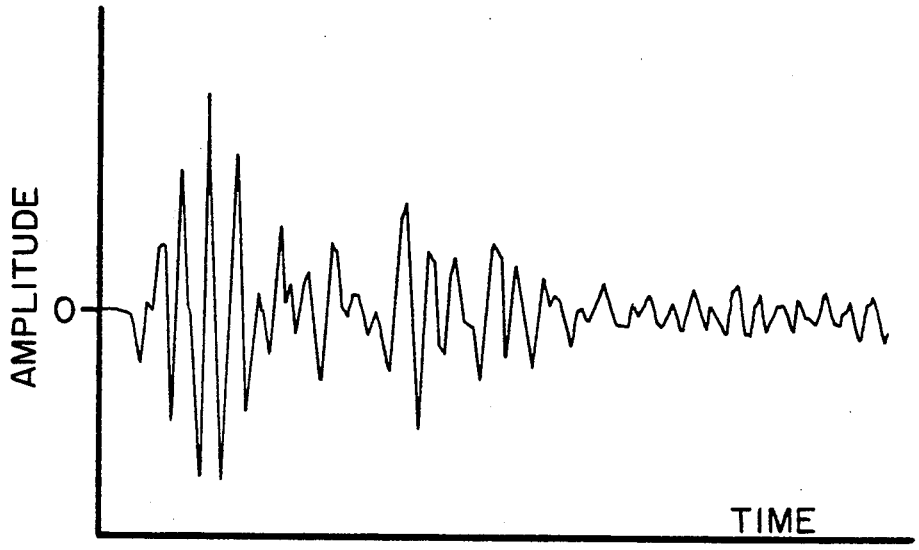
FIGS. 4A and 4B are plots of center string vibration versus time comparing a racquet without a vibration dampener to a racquet with a vibration dampener according to the invention.
Figure 4B:
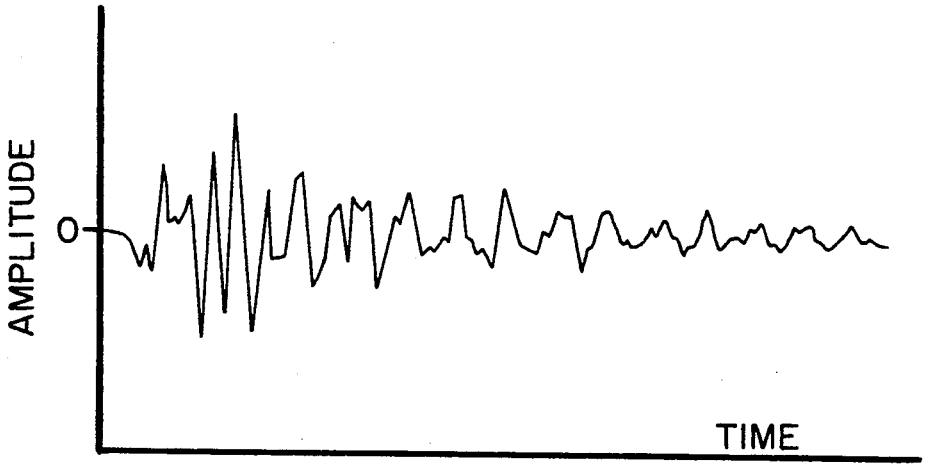
Figure 5A:
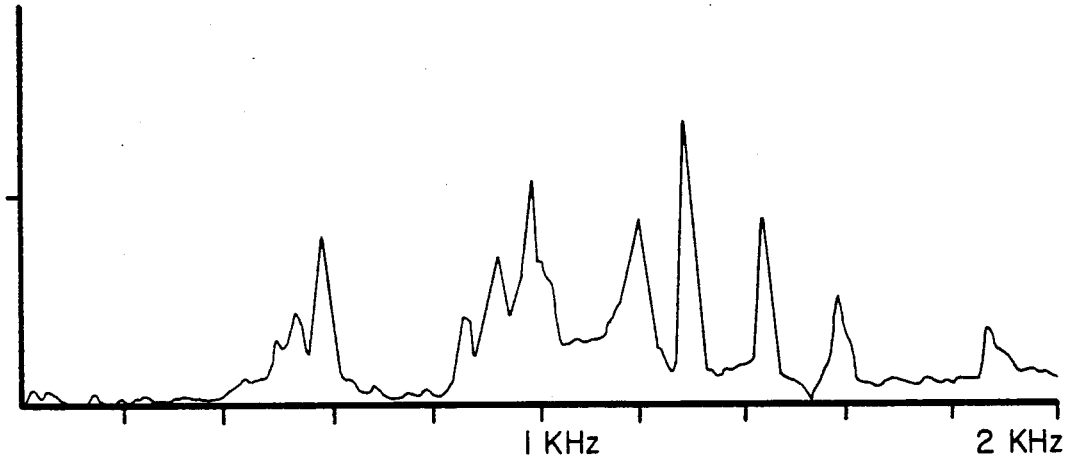
FIGS. 5A and 5B are plots of vibration frequency distribution, for the center strings, of a racquet without a damper versus a racquet with a dampener.
Figure 5B:
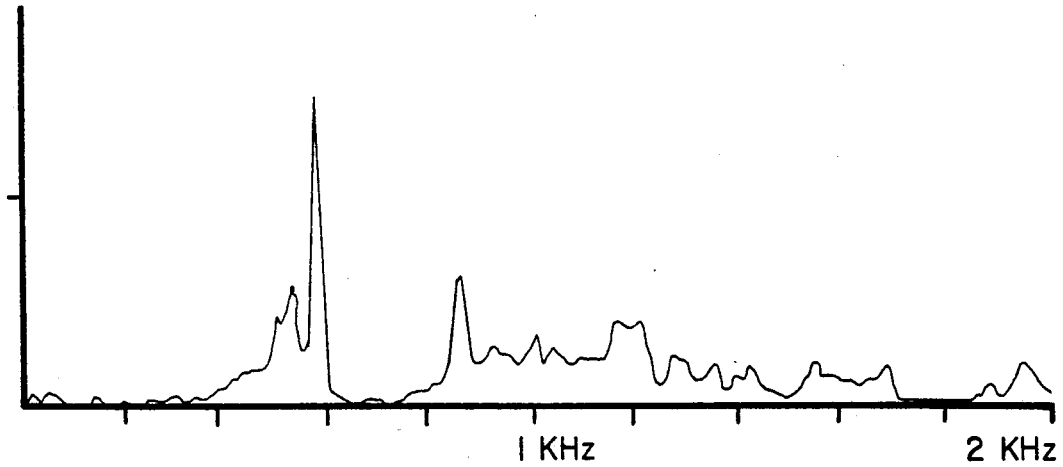

FIGS. 4A, 4B, 5A, and 5B show the response of the center longitudinal strings 34*c* to ball impact. FIGS. 4A to 4B illustrate that the total vibration level is reduced, and is dampened more quickly, when a dampener according to the invention is used. More significantly, FIGS. 5A and 5B show that the characteristic vibration frequencies change.

As shown in FIG. 5A, when a ball hits the strings vibrations occur at different frequencies. The largest amplitude occurs at 1290 Hz, with other significant peaks occurring at about 580 Hz, 950 Hz, 1450 Hz, and so on. In contrast, in FIG. 5B the largest peak occurs at 580 Hz, with the peaks at other frequencies reduced significantly. As described below, reducing these higher frequencies, and focusing the string vibration response at the lower frequency level, is highly favorable.

FIGS. 8, 9, and 10 are computer generated plots illustrating three string vibration patterns, corresponding to the fundamental frequency (618 Hz) and two higher order frequencies (972 and 987 Hz) which occur for the particular dimensions, string pattern and tension of the test racquet.

At the fundamental frequency, as shown in FIG. 8, the string bed acts as a single membrane moving in and out from the plane of the strings at rest, i.e., responds in a "cupping" mode. In contrast to the fundamental vibration mode, as shown in FIGS. 9 and 10 higher order vibration modes produce non-uniform stringbed response and could induce some misdirection in the flight of the rebounded ball.

Returning to FIG. 5B, it is shown that the dampener 10 according to the invention significantly dampens higher order vibrational modes, while allowing the primary cupping mode to exist to its fullest extent. Thus, in addition to the improved vibration dampening ability shown in FIG. 4B, it can be seen that the invention has the added benefit of producing a more favorable string bed response, by selectively reducing higher level vibration.

Figure 6A:
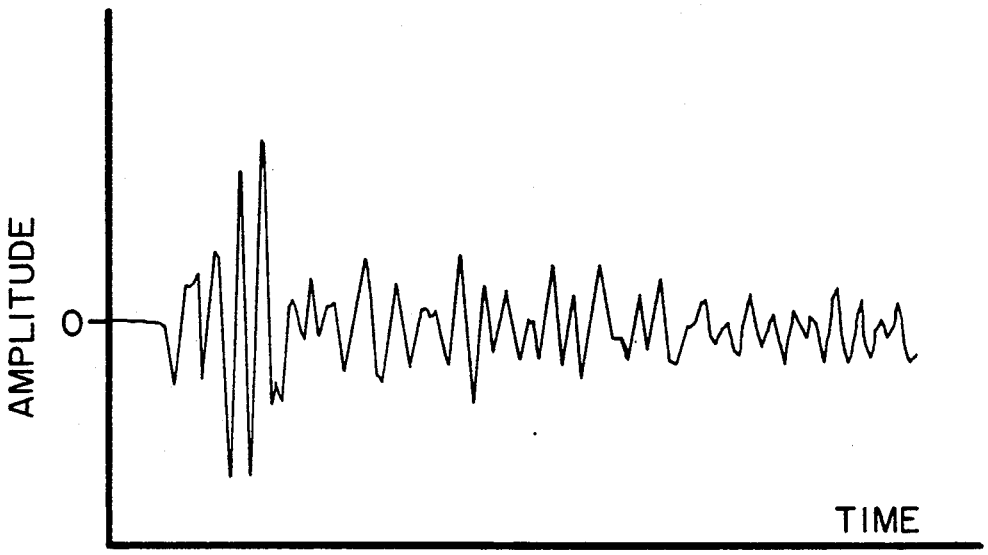
FIGS. 6A and 6B are plots corresponding to FIGS. 4A and 4B, respectively, of vibration two inches away from the center longitudinal axis.
Figure 6B:
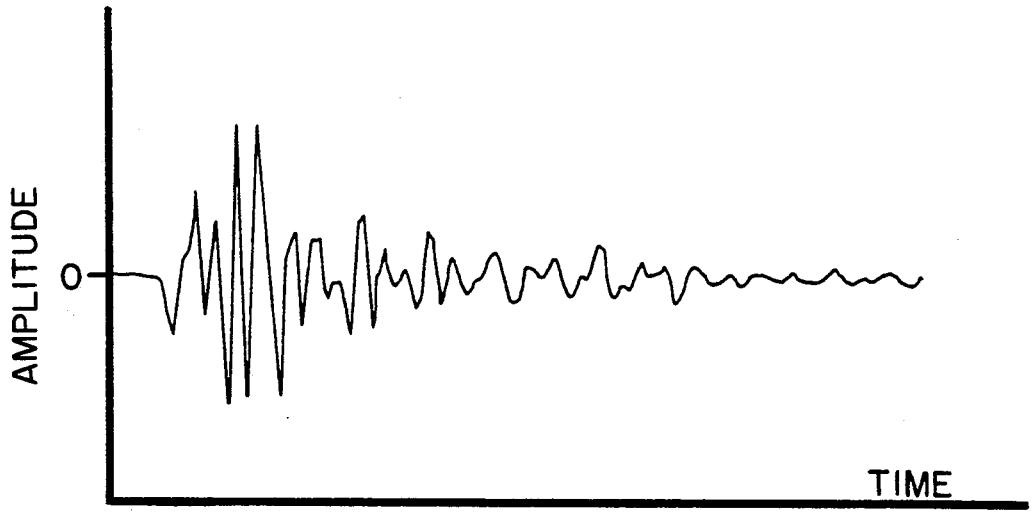
Figure 7A:
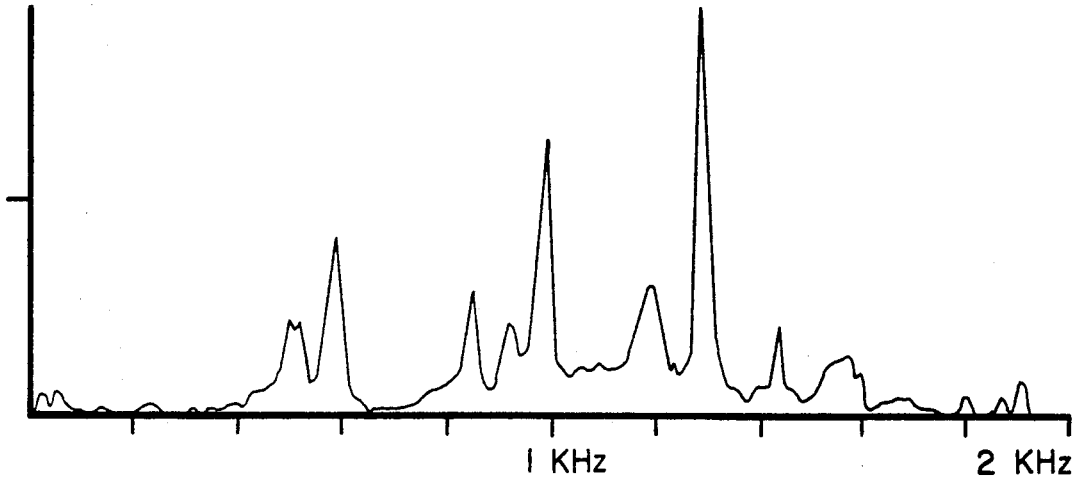
FIGS. 7A and 7B are plots corresponding to FIGS. 5A and 5B, respectively, of the vibration frequency distribution two inches away from the center longitudinal axis.
Figure 7B:
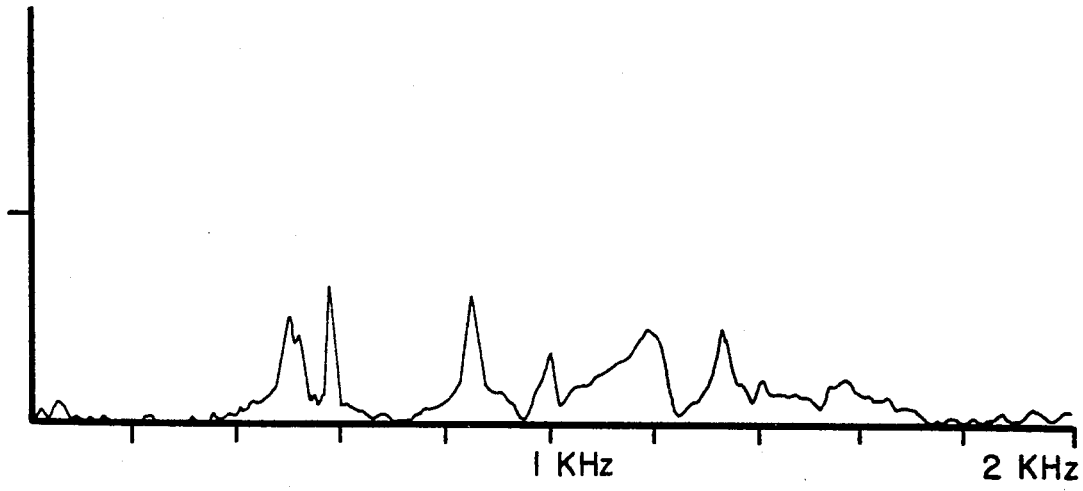

FIGS. 6A, 6B, 7A, and 7B show the response of main strings measured 2 inches off center, e.g., strings 34*a*, to ball impact. FIGS. 6A to 6B illustrate that vibration is dampened more quickly using a dampener according to the invention. Moreover, as shown in FIGS. 7A and 7B, the higher level vibration frequencies are significantly reduced.

Figure 11:
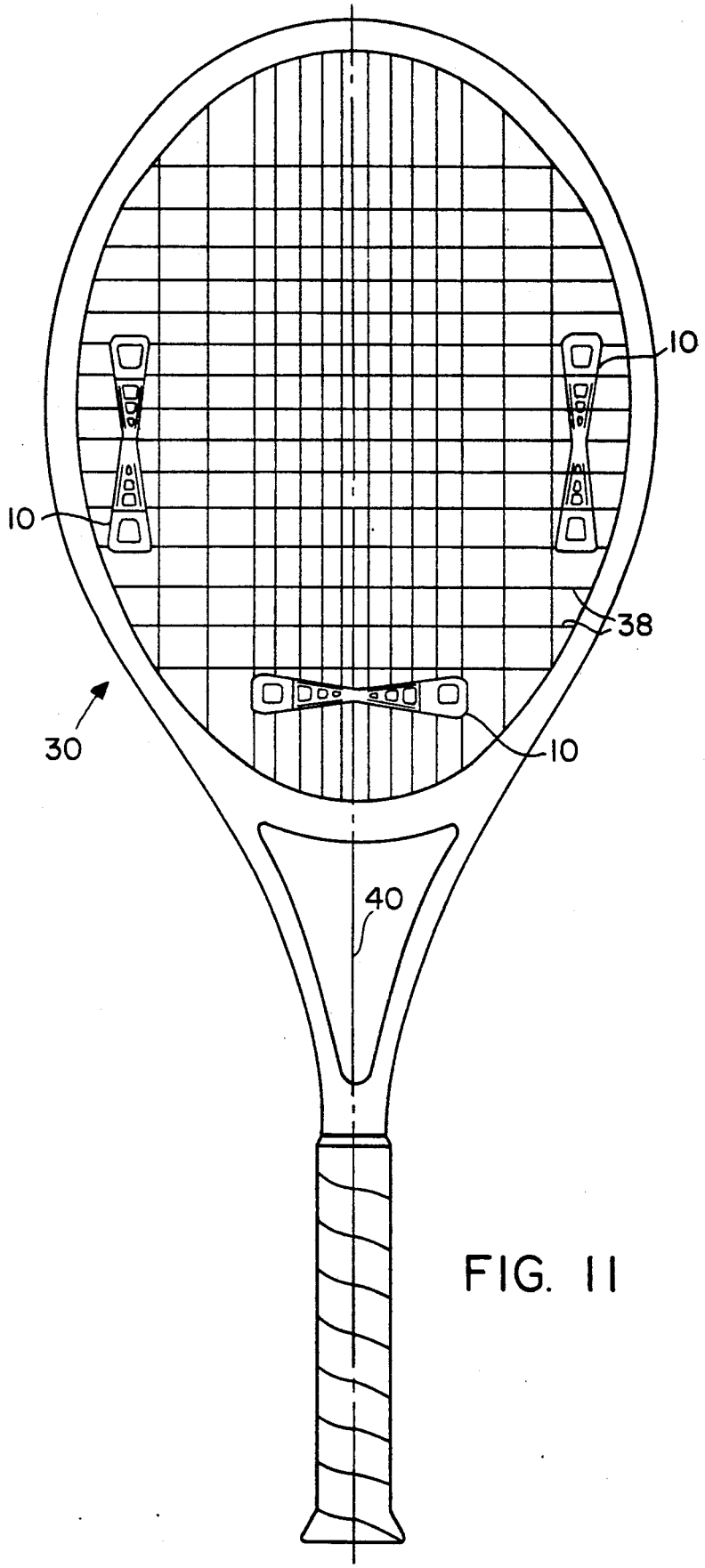
FIG. 11 is a front view of a tennis racquet showing dampeners mounted on both the main and cross strings.

Another method of using the dampener is illustrated in FIG. 11, which shows a tennis racquet including frame 30. A pair of dampeners 10 are mounted on cross strings 38, at the 3 and 9 o'clock positions in the region of the widest portion of the racquet. Because the dampener provides greater dampening adjacent the donut members 14 than in the middle, a dampener which is mounted on the cross strings, so as to extend parallel to the racquet axis 40, provides the benefit of increased dampening of shots hit near the tip and throat, while providing less dampening for balls hit in the middle of the racquet. Preferably, however, if one or more cross string dampeners are used a main string dampener 10 is also used, as shown in FIG. 11.

Although it is possible to use only one cross string dampener, it is preferable to use a pair as shown in FIG. 11 for balance. This has the added benefit of increasing the polar moment of inertia by 0.20 g-m$^2$, which is roughly a 10–15% increase in stability.

The foregoing represent preferred embodiments of the invention. Variations and modifications will be apparent to persons skilled in the art, while still utilizing the inventive principles disclosed herein. For example, other shapes of strips or of the weighted end members may be employed, while still realizing variable string dampening. It is possible to have the end members engage a greater (or lesser) number of strings. It may also be desirable to use different materials for the end members or, instead of using as large a mass, substitute a more vibration absorbent material in the end members to achieve the desired vibration reduction. All such modifications and variations are intended to be within the scope of the invention as defined in the following claims.

I claim:

1. A vibration absorber for use on a sports racquet having adjacent, parallel strings, said absorber comprising: an elongated member, including a connecting portion which is flexible and thin so as to effect relatively little vibration dampening; vibration dampening means on either end of said elongated member for effecting vibration dampening greater than said connecting portion, wherein said vibration dampening means constitute end members; wherein said connecting member is adapted to be weaved over and under adjacent, parallel strings of a sports racquet so as to contact at least two strings, and wherein each end member is sized to fit between a pair of adjacent, parallel strings of a sports racquet so that opposite sides of the end member are in frictional contact with the two parallel strings and thereby produce variable vibration dampening across the stringing plane of the racquet.

2. A vibration absorber according to claim 1, wherein each said end member includes an outwardly facing clamping groove adapted to receive a string.

3. A vibration absorber according to claim 2, wherein the end members have a relatively greater mass per unit length than the connecting portion.

4. A vibration dampener according to claim 3, wherein each end member includes a second clamping groove, on the side opposite to the outwardly facing clamping groove, and wherein said outwardly facing clamping groove and said second clamping groove are spaced from one another a distance suitable for engaging the pair of parallel strings.

5. A vibration absorber for use on a tennis racquet having center main strings and outlying main strings, said absorber comprising: a relatively thin, elastomeric strip having a length which is greater than the distance between the center main strings, and a pair of end sections having a relatively greater mass; wherein each end section includes at least two grooves each sized to receive a string of a tennis racquet so as to be in frictional contact with the string, said grooves on the respective opposite end sections being spaced apart approximately the distance between a pair of outlying main strings of a tennis racquet, wherein the vibration absorber is adapted to be weaved over and under the main strings of a tennis racquet so that the strip contacts the center main strings of the racquet and each end section receives at least two outlying strings of the racquet, said vibration absorber thereby effecting greater vibration dampening in the outlying strings than in the center main strings.

6. A vibration absorber according to claim 5, wherein the strip has a length such that it is adapted to extend over and under at least four adjacent center main strings.

7. A vibration absorber according to claim 6, wherein each end section comprises a donut shaped member; wherein the groove for engaging the first outlying string constitutes an outwardly facing clamping groove in the donut member; and wherein said additional groove constitutes a second clamping groove formed at the junction of the donut member and strip.

8. A vibration absorber according to claim 7, wherein the clamping grooves constitute keyhole shape grooves defined by an outwardly open slot, having a dimension smaller than the string, communicating with a bore having a larger dimension than the slot for seating the string.

9. A vibration absorber according to claim 8, wherein the strip has a width and thickness that taper toward the center, so as to have a bow tie shape.

10. A vibration absorber for use on a sports racquet having strings defining a stringing plane, comprising an elongated flexible member adapted to be weaved over and under at least four strings, and vibration dampening means on at least one end of said elongated member for effecting vibration dampening greater than said elongated flexible member, wherein said vibration dampening means includes at least one groove adapted to receive a string of a sports racquet so as to be in frictional contact with the string, wherein said elongated flexible member is adapted to be weaved into at least four strings of a sports racquet such that at least one string is received in said groove and at least two other strings contact said elongated flexible member, thereby to produce variable vibration dampening across the stringing plane of the racquet.

11. A vibration absorber according to claim 10, wherein said member includes a second string-receiving groove, wherein said grooves are parallel to one another and spaced from one another a distance so as to be adapted to receive a pair of adjacent, parallel strings.

* * * * *